US008090133B2

(12) United States Patent
Yang

(10) Patent No.: US 8,090,133 B2
(45) Date of Patent: Jan. 3, 2012

(54) EARPHONE SPEAKER WITH ESD PROTECTION

(75) Inventor: Bill Yang, Taipei (TW)

(73) Assignee: Cotron Corporation, Taipei (TW)

( * ) Notice: Subject to any disclaimer, the term of this patent is extended or adjusted under 35 U.S.C. 154(b) by 1108 days.

(21) Appl. No.: 11/875,946

(22) Filed: Oct. 21, 2007

(65) Prior Publication Data

US 2009/0041290 A1 Feb. 12, 2009

(30) Foreign Application Priority Data

Aug. 7, 2007 (TW) ..... 96129004 A

(51) Int. Cl.
*H04R 25/00* (2006.01)

(52) U.S. Cl. ..... 381/370; 381/396; 381/411; 381/412

(58) Field of Classification Search ..... 381/370, 381/412, 396, 411
See application file for complete search history.

(56) References Cited

U.S. PATENT DOCUMENTS

| | | | | |
|---|---|---|---|---|
| 2007/0121993 | A1* | 5/2007 | Horigome et al. | 381/396 |
| 2007/0140509 | A1* | 6/2007 | Ueno et al. | 381/96 |
| 2007/0269076 | A1* | 11/2007 | Honda et al. | 381/411 |
| 2007/0274557 | A1* | 11/2007 | Chiba | 381/412 |

FOREIGN PATENT DOCUMENTS

| | | |
|---|---|---|
| CN | 1575210 | 2/2005 |
| CN | 2884763 | 3/2007 |
| DE | 947806 | 8/1956 |
| DE | 3128693 | 2/1982 |
| JP | 2003-009269 | 1/2003 |
| KR | 1020050096435 | 10/2005 |

OTHER PUBLICATIONS

"First Office Action of China Counterpart Application", issued on Apr. 13, 2011, p. 1-p. 3.
"Second Office Action of China Counterpart Application", issued on Sep. 21, 2011, p. 1-p. 4.

* cited by examiner

*Primary Examiner* — Jianchun Qin
(74) *Attorney, Agent, or Firm* — Jianq Chyun IP Office

(57) ABSTRACT

An earphone speaker including a conductive housing, a micro speaker module, and a circuit board is provided. The conductive housing has a holding space. The micro speaker module is disposed in the holding space. The circuit board is disposed outside the conductive housing, and has a first surface facing towards the conductive housing and a second surface corresponding to the first surface. A positive terminal and a negative terminal are disposed on the second surface and electrically connected to the micro speaker module. A conductive material layer is disposed on the first surface and electrically connected to the negative terminal, and the conductive material layer is directly contacted with the conductive housing.

9 Claims, 3 Drawing Sheets

EARPHONE SPEAKER WITH ESD PROTECTION

CROSS-REFERENCE TO RELATED APPLICATION

This application claims the priority benefit of Taiwan application serial no. 96129004, filed Aug. 7, 2007. All disclosure of the Taiwan application is incorporated herein by reference.

BACKGROUND OF THE INVENTION

1. Field of the Invention

The present invention relates to an electronic product, and more particularly to an earphone speaker.

2. Description of Related Art

With the continuous progress of technologies, electronic products are made as thin and light as possible, thus the user can carry the portable electronic products such as mini radio and walkman anytime and anywhere. In addition, the personal digital products such as MP3 players, mobile phones, Personal Digital Assistants (PDA) or laptop (notebook) computers have become indispensable in our daily life. Moreover, the mobile phone equipped with radio and MP3 player has also been introduced in market.

For the electronic products mentioned above, in order for the users to listen to the audio information in the electronic product without disturbing others, a headset has become a mandatory accessory for the electronic products. In addition, the headset provides better transmission of the sounds, such that the user can clearly listen to and understand the audio information, unlike the unclear voice transmitted through the air. Further, the audio information remains stable even when the user is in a motion state, such as exercising, driving, or in a noisy environment.

In order to ensure the earphone not to be damaged due to the electrostatic charges generally existed in the environment, the earphone must pass an electrostatic discharge test before leaving the factory. However, when the earphone speaker adopts a metal housing and a metal dust filter, the conventional design always cannot pass the electrostatic discharge test.

SUMMARY OF THE INVENTION

Accordingly, the present invention is directed to an earphone speaker, which has excellent ESD protection effect.

The earphone speaker of the present invention includes a conductive housing, a micro speaker module, and a circuit board. The conductive housing has a holding space. The micro speaker module is disposed in the holding space. The circuit board is disposed outside the conductive housing and has a first surface facing towards the conductive housing and a second surface corresponding to the first surface. A positive terminal and a negative terminal are disposed on the second surface and electrically connected to the micro speaker module. A conductive material layer is disposed on the first surface and electrically connected to the negative terminal, and the conductive material layer is directly contacted with the conductive housing.

In an embodiment of the earphone speaker, the conductive housing is made of metal.

In an embodiment of the earphone speaker, a dust filter is further included, which is disposed on an opening of the conductive housing to seal the holding space. Furthermore, the dust filter is made of metal.

In an embodiment of the earphone speaker, the micro speaker module includes a speaker vibration system and a magnetic loop. Furthermore, the speaker vibration system includes a vibration film and a coil disposed on the vibration film, in which the coil surrounds the magnetic loop and is electrically connected to the positive terminal and the negative terminal. Furthermore, the magnetic loop includes a magnet and a polepiece.

In an embodiment of the earphone speaker, the circuit board further has a plated through hole (PTH) electrically connected to the negative terminal and the conductive material layer.

In an embodiment of the earphone speaker, the conductive material layer substantially covers the entire second surface.

In view of above, in the earphone speaker of the present invention, the electrostatic charges on the conductive housing can be grounded and discharged through the negative terminal via the conductive material layer of the circuit board. Therefore, the earphone speaker of the present invention has excellent ESD protection effect.

In order to make the aforementioned and other objects, features and advantages of the present invention comprehensible, embodiments accompanied with figures are described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
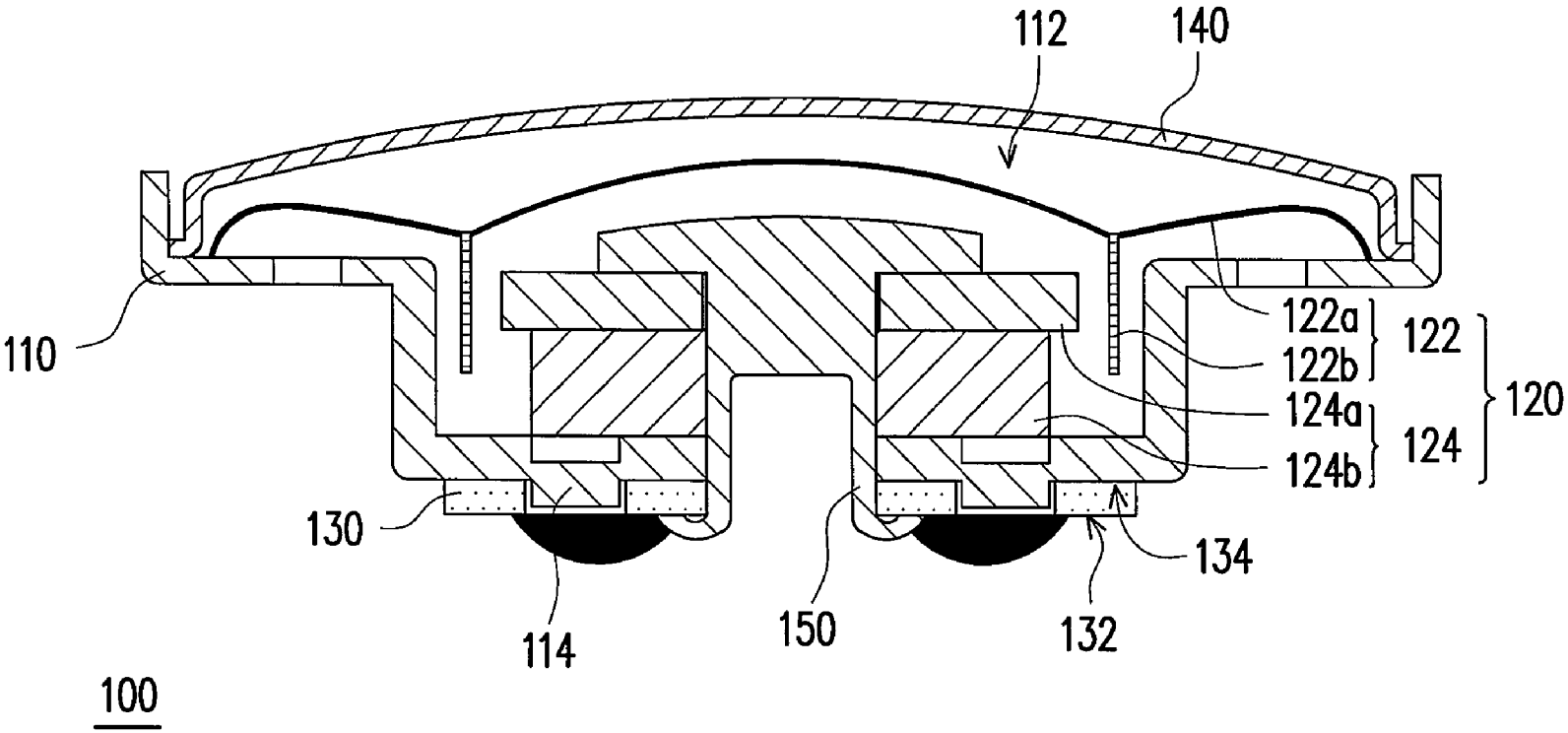
FIG. 1 is a cross-sectional view of an earphone speaker according to the present invention.
Figure 2A:
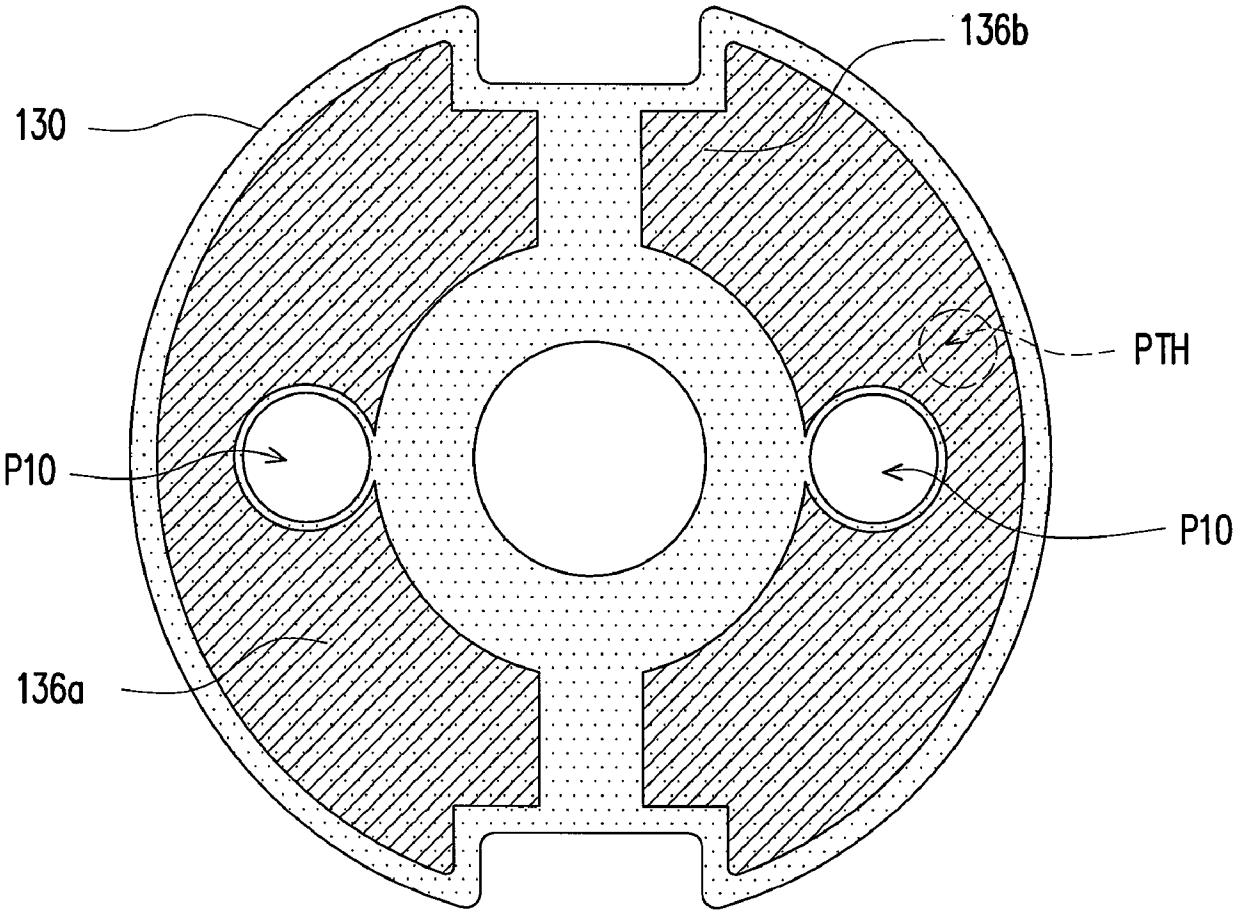
FIGS. 2A and 2B respectively show two surfaces of a circuit board in the earphone speaker in FIG. 1.
Figure 2B:
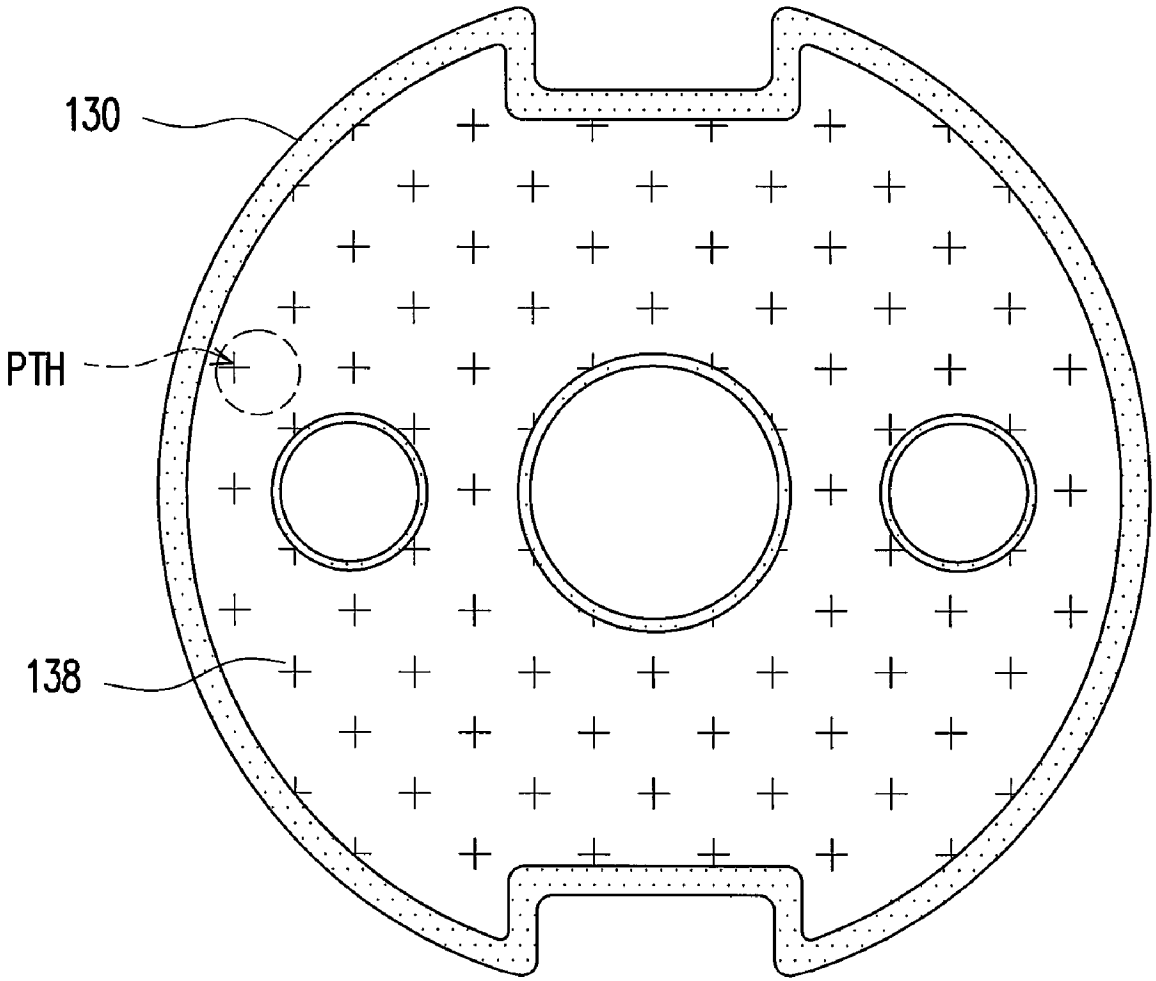

FIG. 1 is a cross-sectional view of an earphone speaker according to the present invention, and FIGS. 2A and 2B respectively show two surfaces of a circuit board in the earphone speaker in FIG. 1. Referring to FIGS. 1, 2B, and 2B, an earphone speaker 100 of this embodiment includes a conductive housing 110, a micro speaker module 120, and a circuit board 130. The conductive housing 110 has a holding space 112, and the micro speaker module 120 is disposed in the holding space 112. The circuit board 130 is disposed outside the conductive housing 110, and has a first surface 134 facing towards the conductive housing 110 and a second surface 132 corresponding to the first surface 134. A positive terminal 136*a* and a negative terminal 136*b* are disposed on the second surface 132 and electrically connected to the micro speaker module 120. A conductive material layer 138 is disposed on the first surface 134 and electrically connected to the negative terminal 136*b*, and the conductive material layer 138 is directly contacted with conductive housing 110.

When electrostatic charges are accumulated on the conductive housing 110 of the earphone speaker 100, as the conductive material layer 138 is electrically connected to the negative terminal 136*b*, the electrostatic charges can be transferred to the negative terminal 136*b* via the conductive material layer 138 directly contacted with the conductive housing 110, and then the electrostatic charges are discharged through the ground line (not shown) electrically connected to the negative terminal 136*b*. Therefore, the earphone speaker 100 of this embodiment has excellent ESD protection effect, and can also easily pass the electrostatic discharge test. Experiment shows that, the earphone speaker 100 of this embodiment can easily endure 15 KV electrostatic charges without being damaged in a contact electrostatic discharge test. Furthermore, as the circuit board 130 is inherently fixed on the conductive housing 110 and directly contacted with the conductive housing 110 in the prior art, it is not necessary to re-design the fixation between the circuit board 130 and the conductive housing 110, without requiring additional assembling steps. Furthermore, the electrostatic charges are discharged through the ground line originally used in the micro speaker module 120, so it is unnecessary to additionally design any specific lines.

For example, the conductive housing 110 may be made of metal or other suitable conductive materials. Furthermore, the circuit board 130 further has, for example, a PTH. The PTH refers to one through hole in the circuit board 130, the wall of the through hole is plated with a conductive material, and two ends of the conductive material on the wall of the through hole are respectively contacted with the negative terminal 136*b* and the conductive material layer 138, and thus enables the negative terminal 136*b* to be electrically connected with the conductive material layer 138. Definitely, the negative terminal 136*b* and the conductive material layer 138 can also be electrically connected through other suitable manners. Furthermore, the conductive material layer 138, for example, but not limited to, substantially covers the entire second surface 132. Moreover, the circuit board 130 further has two positioning holes P10, and the conductive housing 110 has, for example, two projections 114 corresponding to the positioning holes P10. When the circuit board 130 is disposed outside the conductive housing 110, the projections 114 are positioned in the positioning holes P10 and thus positioning the circuit board 130, so as to avoid the rotation of the circuit board 130. The design of the projections 114 and the positioning holes P10 is merely taken as an example for demonstrating the present invention, however, those of ordinary skill in the art should know that there are many suitable designs that can achieve the same function in the present invention, which will not be illustrated one by one.

Furthermore, the earphone speaker 100 can further include a dust filter 140, disposed on an opening of the conductive housing 110, so as to seal the holding space 112. Specifically, the sound outlet surface of the micro speaker module 120 can face towards the dust filter 140. Furthermore, the dust filter 140 is made of, for example, metal or other suitable materials.

In this embodiment, the micro speaker module 120 includes a speaker vibration system 122 and a magnetic loop 124. Furthermore, the speaker vibration system 122 can include a vibration film 122*a* and a coil 122*b* disposed on the vibration film 122*a*, and the coil 122*b* surrounds the magnetic loop 124 and is electrically connected to the positive terminal 136*a* and the negative terminal 136*b*. Moreover, the magnetic loop 124 includes a polepiece 124*a* and a magnet 124*b*. Two ends of the coil 122*b* are respectively electrically connected to the positive terminal 136*a* and the negative terminal 136*b* and further electrically connected to a power line (not shown) and the ground line through the positive terminal 136*a* and the negative terminal 136*b*. Furthermore, the polepiece 124*a*, the magnet 124*b*, and the circuit board 130 are together fixed on the conductive housing 110 by, for example, a rivet 150. Definitely, they can also be fixed through other proper manners.

In view of above, in the earphone speaker of the present invention, the circuit board has a conductive material layer on the surface facing towards the conductive housing, and the conductive material layer is electrically connected to the negative terminal on the other surface of the circuit board. Therefore, when electrostatic charges are accumulated on the conductive housing of the earphone speaker, they can be grounded and discharged through the conductive material layer and the negative terminal. In such a manner, the earphone speaker of the present invention can achieve an excellent ESD protection effect, without adding additional components or additional assembling steps.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An earphone speaker, comprising:

a conductive housing, having a holding space;

a micro speaker module, disposed in the holding space; and a circuit board, disposed outside the conductive housing, having a first surface facing towards the conductive housing and a second surface corresponding to the first surface, wherein a positive terminal and a negative terminal are disposed on the second surface and electrically connected to the micro speaker module, a conductive material layer is disposed on the first surface and electrically connected to the negative terminal, and the conductive material layer is directly contacted with the conductive housing.

2. The earphone speaker as claimed in claim 1, wherein the conductive housing is made of metal.

3. The earphone speaker as claimed in claim 1, further comprising a dust filter disposed on an opening of the conductive housing, so as to seal the holding space.

4. The earphone speaker as claimed in claim 3, wherein the dust filter is made of metal.

5. The earphone speaker as claimed in claim 1, wherein micro speaker module comprises a speaker vibration system and a magnetic loop.

6. The earphone speaker as claimed in claim 5, wherein the speaker vibration system comprises a vibration film and a coil disposed on the vibration film, and the coil surrounds the magnetic loop and is electrically connected to the positive terminal and the negative terminal.

7. The earphone speaker as claimed in claim 5, wherein the magnetic loop comprises a magnet and a polepiece.

8. The earphone speaker as claimed in claim 1, wherein the circuit board further comprises a plated through hole, electrically connected to the negative terminal and the conductive material layer.

9. The earphone speaker as claimed in claim 1, wherein the conductive material layer substantially covers the entire second surface.

* * * * *